US012325896B2

(12) United States Patent
Brodjonegoro et al.

(10) Patent No.: US 12,325,896 B2
(45) Date of Patent: Jun. 10, 2025

(54) TREATMENT METHOD AND APPLICATION FOR LATERITE NICKEL ORE LEACHING SOLUTION WITH HIGH CALCIUM AND MAGNESIUM CONTENT

(71) Applicants: PT ESG NEW ENERGY MATERIAL, Jakarta (ID); PT QMB NEW ENERGY MATERIALS, Jakarta (ID); GEM CO., LTD., Shenzhen (CN); PT GEM INDONESIA NEW ENERGY MATERIALS, Jakarta (ID)

(72) Inventors: Satryo Soemantri Brodjonegoro, Jakarta (ID); Kaihua Xu, Shenzhen (CN); Rizky Wanaldi, Jakarta (ID); Tegar Mukti Aji, Jakarta (ID); Aad Alief Rasyidi Baking, Jakarta (ID); Andi Syaputra Hasibuan, Jakarta (ID); Piyan Rahmadi, Jakarta (ID); Wei Liu, Jakarta (ID)

(73) Assignees: PT ESG NEW ENERGY MATERIAL, Jakarta (ID); PT QMB NEW ENERGY MATERIALS, Jakarta (ID); GEM CO., LTD., Shenzhen (CN); PT GEM INDONESIA NEW ENERGY MATERIALS, Jakarta (ID)

( * ) Notice: Subject to any disclaimer, the term of this patent is extended or adjusted under 35 U.S.C. 154(b) by 0 days.

(21) Appl. No.: 18/870,477

(22) PCT Filed: Jul. 31, 2023

(86) PCT No.: PCT/CN2023/110218
§ 371 (c)(1),
(2) Date: Nov. 29, 2024

(87) PCT Pub. No.: WO2025/025056
PCT Pub. Date: Feb. 6, 2025

(65) Prior Publication Data
US 2025/0115978 A1 Apr. 10, 2025

(51) Int. Cl.
*C22B 23/00* (2006.01)
*C22B 3/00* (2006.01)
*C22B 3/32* (2006.01)

(52) U.S. Cl.
CPC ..... *C22B 23/0461* (2013.01); *C22B 3/32* (2021.05)

(58) Field of Classification Search
None
See application file for complete search history.

(56) References Cited

U.S. PATENT DOCUMENTS

2002/0053260 A1* 5/2002 Nakon ..... C21B 15/00 75/721

FOREIGN PATENT DOCUMENTS

CN 112458314 * 3/2021
CN 112458314 A 3/2021

OTHER PUBLICATIONS

Claims of PCT/CN2023/110218.
CNIPA (ISA), Written opinion for PCT/CN2023/110218, Nov. 22, 2023.

* cited by examiner

*Primary Examiner* — Sheng H Davis
(74) *Attorney, Agent, or Firm* — Hemisphere Law, PLLC; Zhigang Ma

(57) ABSTRACT

A treatment method and application for laterite nickel ore leaching solution with high calcium and magnesium content, comprising the following steps: S1. preparing an extracted organic phase from the 2-hexyldecanoic acid and the HBL110/HBL116 extractant; S2. performing nickel-cobalt co-extraction on the extracted organic phase and a laterite (Continued)

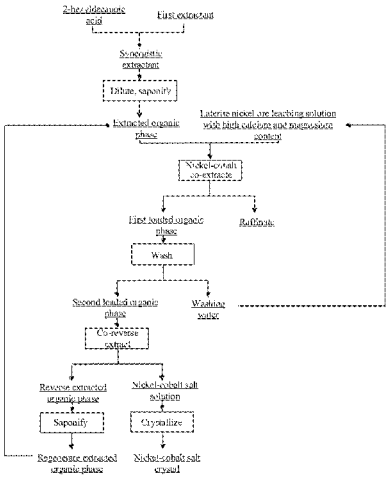

nickel ore leaching solution with a high calcium and magnesium content to obtain a first loaded organic phase and a raffinate; in a laterite nickel ore leaching solution with a high calcium and magnesium content; S3. washing the first loaded organic phase with a washing solution to obtain a second loaded organic phase and washing water, wherein the washing water is refluxed to a laterite nickel ore leaching solution with high calcium and magnesium content; S4. adding a reverse extracting solution to the second loaded organic phase for reverse extracting to obtain a nickel-cobalt salt solution and a reverse extracted organic phase; S5. saponifying the reverse extracted organic phase to obtain a regenerated extracted organic phase; this scheme is applicable to the environment with high calcium and magnesium, can prevent calcium and magnesium from forming a third phase, and the effect of separating and purifying nickel and cobalt is good.

10 Claims, 1 Drawing Sheet

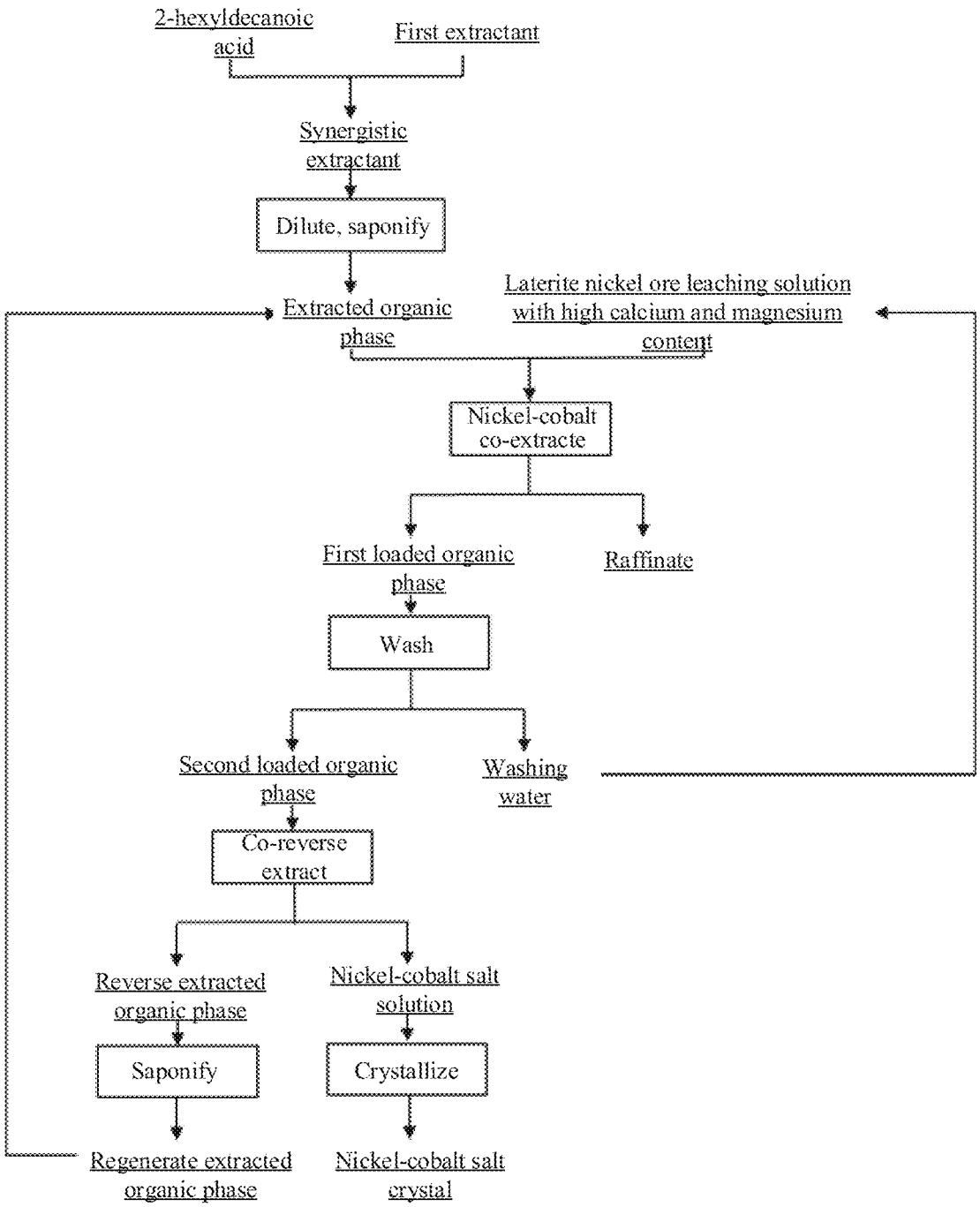
2-hexyldecanoic acid
First extractant
Synergistic extractant
Dilute, saponify
Extracted organic phase
Laterite nickel ore leaching solution with high calcium and magnesium content
Nickel-cobalt co-extracte
First loaded organic phase
Raffinate
Wash
Second loaded organic phase
Washing water
Co-reverse extract
Reverse extracted organic phase
Nickel-cobalt salt solution
Saponify
Crystallize
Regenerate extracted organic phase
Nickel-cobalt salt crystal

TREATMENT METHOD AND APPLICATION FOR LATERITE NICKEL ORE LEACHING SOLUTION WITH HIGH CALCIUM AND MAGNESIUM CONTENT

FIELD OF THE DISCLOSURE

The disclosure relates to the technical field of hydrometallurgy, and in particular to a treatment method and application for laterite nickel ore leaching solution with high calcium and magnesium content.

BACKGROUND

Under the dual pressure of energy and environmental protection, the new energy automobile industry develops rapidly and its industrialization process is accelerating. However, with the depletion of nickel sulfide ore, the current and future supply of battery-grade raw materials is far from meeting the strong market demand for new energy vehicles. How to deal with laterite nickel ore directly by hydrometallurgy for deep separation and recovery of impurities to obtain battery-grade nickel-cobalt raw materials while reducing the production cost of automotive batteries has become a long-term development challenge for new energy enterprises.

In the high-pressure acid leaching process of laterite nickel ore, a large amount of magnesium and calcium are also leached into the laterite nickel ore leaching solution to form a laterite nickel ore leaching solution with a high calcium and magnesium content, which is not conducive to the recovery of nickel and cobalt. In the related art, a hydrometallurgical process for extracting battery-grade nickel and cobalt from a laterite nickel ore leaching solution with a high calcium and magnesium content mainly comprises a precipitation method and an extraction method. Since the pH of hydrolysis of calcium and magnesium is higher than that of nickel and cobalt when using a precipitation method to purify nickel and cobalt, fluoride such as sodium fluoride or ammonium fluoride is generally added to remove calcium and magnesium by forming an insoluble precipitate with magnesium and calcium; however, this process not only requires the consumption of large amounts of relatively expensive fluorides and is economically expensive, but also facilitates the introduction of fluoride ions and fluorides of nickel and cobalt, with the loss of large amounts of nickel and cobalt accompanied by the entrainment of calcium, magnesium and fluoride ions in the resulting nickel and cobalt product. Related Art In an industrial extraction process, calcium in a laterite nickel ore leaching solution with a high calcium and magnesium content is first removed using P204, then cobalt is extracted through P507, magnesium is extracted through P507, and the leaching solution is deeply deducted through C272, and finally nickel and cobalt are enriched to a target concentration of a battery-grade nickel and cobalt raw material through a special nickel and cobalt enrichment line. The process is cumbersome and costly, and the dispersion loss of nickel and cobalt is high. Furthermore, calcium and a small part of magnesium in the related process are hydrolyzed to form a third phase and continuously enriched in the extracted organic phase, so that the extraction tank cannot operate normally, and the extraction rate of nickel and cobalt and the purity of the final product are seriously affected. Separation of calcium and magnesium in a leaching solution with a low calcium and magnesium content does not suffer from the above-mentioned problems.

Therefore, for the treatment method for laterite nickel ore leaching solution with high calcium and magnesium content different from the design idea of the treatment method for laterite nickel ore leaching solution with a low calcium and magnesium content; it is necessary to design a treatment method for laterite nickel ore leaching solution with high calcium and magnesium content with short process, low cost and good purification effect of nickel and cobalt.

SUMMARY

In view of this, the disclosure provides a treatment method and application for laterite nickel ore leaching solution with high calcium and magnesium content, which has good nickel-cobalt purification effect.

In order to achieve the above technical object, the disclosure adopts the following technical solution:

In a first aspect, the disclosure provides a treatment method for laterite nickel ore leaching solution with high calcium and magnesium content, including the following steps:

S1. preparing a synergistic extractant from 2-hexyldecanoic acid and a first extractant, diluting the synergistic extractant by adding a diluent, and then saponifying with a liquid alkali to obtain an extracted organic phase, wherein the first extractant is an HBL110 extractant or an HBL116 extractant;

S2. mixing the extracted organic phase with a laterite nickel ore leaching solution with a high calcium and magnesium content, and performing nickel-cobalt co-extraction to obtain a first loaded organic phase and a raffinate; wherein in the laterite nickel ore leaching solution with a high calcium and magnesium content, the content of calcium ions is 0.5-1 g/L, the content of magnesium ions is 4-7 g/L, the content of nickel ions is 2.5-4 g/L and the content of cobalt ions is 0.2-0.5 g/L;

S3. washing the first loaded organic phase with a washing solution to obtain a second loaded organic phase and washing water, wherein the washing water is refluxed to a laterite nickel ore leaching solution with a high calcium and magnesium content;

S4. adding a reverse extracting solution to the second loaded organic phase for reverse extracting to obtain a nickel-cobalt salt solution product and a reverse extracted organic phase, and crystallizing the nickel-cobalt salt solution to obtain a nickel-cobalt salt;

S5. saponifying the reverse extracted organic phase to obtain a regenerated extracted organic phase.

Preferably, the volume ratio of 2-hexyldecanoic acid to the first extractant is 1:3-15.

Preferably, in step S1, the diluent includes one or more of sulfonated kerosene, 260 #solvent oil, or Escaid 110 solvent oil, and the saponifying agent includes one or more of sodium hydroxide, nickel hydroxide, and ammonia.

Preferably, in step S1, the dilution rate of the synergistic extractant is 10-50%, the saponification rate is 20-70%, and the order of saponification is 1-2.

Preferably, in step S2, the volume ratio of the extracted organic phase to the laterite nickel ore leaching solution with a high calcium and magnesium content is 1:0.5-7, and the order of extraction of the nickel-cobalt co-extraction is 1-13.

Preferably, in step S3, the concentration of the washing solution is 0.05-0.5 mol/L, the volume ratio of the first loaded organic phase to the washing solution is 1:0.1-0.5, and the order of washing is 1-10; the washing solution comprises one or more of a sulfuric acid solution, a hydrochloric acid solution, a nitric acid solution, a phosphoric acid solution, an acetic acid solution and a citric acid solution.

Preferably, in step S4, the concentration of the reverse extracting solution is 0.5-2.5 mol/L, the volume ratio of the second loaded organic phase to the reverse extracting solution is 1:0.05-1, and the order of reverse extraction is 2-8; the reverse extracting solution comprises one or more of a sulfuric acid solution, a hydrochloric acid solution, a nitric acid solution, a phosphoric acid solution, an acetic acid solution and a citric acid solution.

Preferably, in step S5, the order of saponification is from 1-2.

In a second aspect, the disclosure provides a nickel-cobalt salt crystal.

In a third aspect, the disclosure provides the use of a nickel-cobalt salt crystal in a battery.

The advantageous effects of the disclosure are as follows:

1. The treatment method for laterite nickel ore leaching solution with high calcium and magnesium content in the disclosure has a short process flow, a low cost, and a good extraction effect;
2. The disclosure can obtain a battery-grade nickel-cobalt sulfate product from a laterite nickel ore leaching solution with a high calcium and magnesium content by a one-step co-extraction process;
3. The disclosure solves the problems of a long process flow for purifying nickel and cobalt from a laterite nickel ore leaching solution with a high calcium and magnesium content and easy hydrolysis of calcium and magnesium to form a third phase during the extraction in the prior art, reduces the large consumption of various chemical reagents during the purification of nickel and cobalt, improves the purity of the nickel and cobalt product, and greatly reduces the overall cost of nickel and cobalt recovery;
4. The synergistic extractant system used in the disclosure has a small water solubility and a large separation coefficient for nickel, cobalt, and calcium, magnesium, and can completely extract nickel and cobalt from a laterite nickel ore leaching solution with a high calcium and magnesium content, reducing the pressure during wastewater treatment, and at the same time, the purity of the obtained nickel and cobalt product is extremely high, providing a high-quality and cost-effective raw material guarantee for a ternary battery positive electrode material.

BRIEF DESCRIPTION OF THE DRAWING

FIGURE is a process flowchart of this scheme.

DETAILED DESCRIPTION OF PREFERRED EMBODIMENTS

In order that the objects, aspects, and advantages of the disclosure will become more apparent, a more particular description of the invention will be rendered by reference to specific embodiments thereof. It should be understood that the particular embodiments described herein are illustrative only and are not limiting.

In order to achieve the above technical object, the disclosure adopts the following technical solution:

As shown in FIGURE, the disclosure provides a treatment method for laterite nickel ore leaching solution with high calcium and magnesium content, including the following steps:

S1. preparing a synergistic extractant from 2-hexyldecanoic acid (C16H3202) and a first extractant, diluting the synergistic extractant by adding a diluent, and then saponifying with a liquid alkali to obtain an extracted organic phase, wherein the first extractant is an HBL110 extractant or an HBL116 extractant;

S2. mixing the extracted organic phase with a laterite nickel ore leaching solution with a high calcium and magnesium content, and performing nickel-cobalt co-extraction to obtain a first loaded organic phase and a raffinate; wherein in the laterite nickel ore leaching solution with a high calcium and magnesium content, the content of calcium ions is 0.7 g/L, the content of magnesium ions is 6 g/L, the content of nickel ions is 2.5-4 g/L and the content of cobalt ions is 0.2-0.5 g/L;

S3. washing the first loaded organic phase with a washing solution to obtain a second loaded organic phase and washing water, wherein the washing water is refluxed to a laterite nickel ore leaching solution with a high calcium and magnesium content; the washing solution includes one or more of a sulfuric acid solution, a hydrochloric acid solution, a nitric acid solution, a phosphoric acid solution, an acetic acid solution, and a citric acid solution;

S4. adding a reverse extracting solution to the second loaded organic phase for reverse extracting to obtain a nickel-cobalt salt solution product and a reverse extracted organic phase, and crystallizing the nickel-cobalt salt solution to obtain a nickel-cobalt salt; and S5. saponifying the reverse extracted organic phase to obtain a regenerated extracted organic phase.

The synergistic extractant in the disclosure is an extraction system composed of 2-hexyldecanoic acid and HBL110 extractant, or an extraction system composed of 2-hexyldecanoic acid and HBL116 extractant. In the disclosure, the nature, mechanism of use, and effect of the HBL110 extractant are the same as those of the HBL116 extractant. 2-hexyldecanoic acid ($C_{16}H_{32}O_2$), the HBL110 extractant and the HBL116 extractant are all commercially available chemical reagents.

The method of the disclosure applies to various acidic or even neutral leaching solution such as sulfuric acid, hydrochloric acid, nitric acid, and oxalic acid containing nickel and cobalt and high calcium, high magnesium, or high calcium and magnesium, such as laterite nickel ore, nickel sulfide ore, and wastewater, and finally, various products such as nickel or cobalt and nickel-cobalt mixed sulfate, chloride, carbonate, acetate, and oxalate can be obtained.

The process flow and principle of this scheme are as follows:

In the present scheme, an extracted organic phase is prepared in step S1, and 2-hexyldecanoic acid and a first extractant are combined to form a synergistic extraction system, wherein the extraction system has a small water solubility and a large separation coefficient for nickel, cobalt and calcium and magnesium, and the nickel and cobalt in a laterite nickel ore leaching solution with a high calcium and magnesium content can be completely extracted and cleaned, and under the extraction system, calcium and magnesium do not hydrolyze to form a third phase; It should be noted that the extraction system includes, in addition to being less water soluble, the following synergistic mechanism: 2-hexyldecanoic acid ($C_{16}H_{32}O_2$) has a large separation coefficient for nickel, cobalt and calcium and magnesium. However, as a typical carboxylic acid extractant, the pH of the raffinate solution after co-extraction of nickel and cobalt is significantly higher than that of the leaching solution, which results in a large amount of calcium and part of magnesium from the hydrolysis of the precipitate continuously enriched in the organic phase, making the extraction tank unable to operate normally. The extraction of cobalt by HBL110 is relatively low with respect to nickel, the cobalt in the wash stage is readily eluted into the wash liquor, and the cobalt concentration in the laterite nickel ore leaching solution is inherently low, thus providing a low recovery rate of cobalt. However, the pH of the raffinate does not increase relative to the leaching solution after HBL110 extraction, in which case there is no hydrolysis of the high calcium and magnesium content. Therefore, on the basis of adjusting and optimizing the contents of the two extractants, the synergistic extractant composed of the two extraction agents can achieve the purpose of simultaneously recovering nickel and cobalt from the leaching solution with high calcium and high magnesium contents, while solving the problem of calcium and magnesium hydrolysis. Step S2 is a nickel-cobalt co-extraction, wherein the nickel-cobalt co-extraction is performed on the extracted organic phase obtained in step S1 using the laterite nickel ore leaching solution with a high calcium and magnesium content, and all the nickel-cobalt and a small amount of calcium and magnesium in the obtained first loaded organic phase loaded with the laterite nickel ore leaching solution with a high calcium and magnesium content enter the raffinate for removal; in order to further improve the purity of nickel and cobalt, in step S3, the first loaded organic phase loaded with all the nickel and cobalt and a small amount of calcium and magnesium is washed, after washing with a washing solution, the calcium and magnesium in the first loaded organic phase is transferred, the first loaded organic phase is converted into a second loaded organic phase containing only nickel and cobalt, and the washing water contains a small amount of nickel and cobalt and calcium and magnesium in the first loaded organic phase; in order to further improve the recovery rate of nickel and cobalt, in step S3, the washing water is also combined into the laterite nickel ore leaching solution with a high calcium and magnesium content of step S2 for refluxing, and nickel-cobalt co-extraction is performed again as an extraction object; step S4 is a reverse co-extraction process, and the purpose thereof is to transfer nickel and cobalt in the second loaded organic phase to an aqueous phase to obtain a nickel-cobalt salt solution, while the organic phase after reverse extracting obtained after the reverse co-extraction still contains the synergistic extractant component of the present scheme, and in order to save raw materials and improve the co-extraction effect, step S5 regenerates the synergistic extractant in the reverse extracted organic phase, and obtains a regenerated extracted organic phase.

The volume ratio of 2-hexyldecanoic acid to the first extractant is: 1:5-15, at this ratio, the synergistic extractant has the best effect in separating nickel and cobalt from the laterite nickel ore leaching solution with a high calcium and magnesium content, on the contrary, if the ratio of 2-hexyldecanoic acid is too high, calcium and magnesium will be hydrolyzed; if the first extractant is too high, the recovery rate of cobalt is too low. Preferably, the volume ratio of 2-hexyldecanoic acid to the first extractant is 1:8.

In step S1, the diluent comprises one or more of sulfonated kerosene, 260 #solvent oil, or Escaid 110 solvent oil; preferably, the diluent is sulfonated kerosene, and the saponifying agent comprises one or more of sodium hydroxide, nickel hydroxide and ammonia.

In step S1, the saponifying agent is a liquid, including but not limited to one or more of sodium hydroxide, potassium hydroxide, ammonia, and in some embodiments, the concentration of the liquid alkali is 10-30%.

In step S1, the dilution rate of the synergistic extractant is 10-50%, the saponification rate is 20-70%, and the order of saponification is 1-2. Suitably, but not exclusively, dilution rates of the synergistic extractant are 10%, 20%, 30%, 40%, and 50%; suitably, but not exclusively, saponification rates are 20%, 30%, 40%, 50%, 60%, 70%.

In step S2, the volume ratio of the extracted organic phase to the laterite nickel ore leaching solution with a high calcium and magnesium content is 1:0.2-3, and the order of extraction of the nickel-cobalt co-extraction is 1-13; suitably, but not exclusively, volume ratios of the extracted organic phase to the laterite nickel ore leaching solution with a high calcium and magnesium content are 1:0.2, 1:0.5, 1:1, 1:2, 1:3; suitably, but not exclusively, the order of extraction for the nickel-cobalt co-extraction are 1, 2, 3, 4, 5, 6, 7, 8, 9, 10, 11, 12 and 13.

In step S3, the concentration of the washing solution is 0.05-0.5 mol/L, the volume ratio of the first loaded organic phase to the washing solution is 1:0.1-0.5, and the order of washing is 1-10; suitably, but not exclusively, the concentration of the washing solution is 0.2 mol/L, 0.3 mol/L, 0.4 mol/L, 0.5 mol/L; suitably, but not exclusively, the volume ratio of the first loaded organic phase to the washing solution is 1:0.1, 1:0.2, 1:0.3, 1:0.4, 1:0.5; suitably, but not exclusively, the order of washing is 1, 2, 3, 4, 5, 6, 7, 8, 9, 10, 11, 12; the washing solution comprises one or more of a sulfuric acid solution, a hydrochloric acid solution, a nitric acid solution, a phosphoric acid solution, an acetic acid solution and a citric acid solution.

In step S4, the concentration of the reverse extracting solution is 0.5-1.5 mol/L, the volume ratio of the second loaded organic phase to the reverse extracting solution is 1:0.05-1, and the order of reverse extraction is 2-8; suitably, but not exclusively, the concentration of the reverse extracting solution is 0.5 mol/L, 0.8 mol/L, 1.0 mol/L, 1.5 mol/L, 2 mol/L and 2.5 mol/L; suitably, but not exclusively, the volume ratio of the second loaded organic phase to the reverse extracting solution is 1:0.1, 1:0.2, 1:0.5, 1:0.8, 1:1; suitably, but not exclusively, the order of reverse extraction is 2, 3, 4, 5, 6, 7, 8; the reverse extracting solution comprises one or more of a sulfuric acid solution, a hydrochloric acid solution, a nitric acid solution, a phosphoric acid solution, an acetic acid solution and a citric acid solution.

In step S5, the order of saponification is 1-2.

The disclosure provides a nickel-cobalt salt, and the nickel-cobalt salt of the disclosure is derived from a laterite nickel ore leaching solution with a high calcium and magnesium content, and in some embodiments, the content of nickel ions and cobalt ions in the laterite nickel ore slurry having a high calcium and magnesium content is 3.6 g/L and 0.35 g/L, respectively.

The disclosure provides the use of a nickel-cobalt salt in a battery, and since the nickel-cobalt salt of the disclosure has a low content of impurities and a high purity, the nickel-cobalt salt has good cyclability and safety when used in a positive electrode material of a ternary battery.

This scheme is further illustrated below by specific examples.

Example 1

A treatment method for laterite nickel ore leaching solution with high calcium and magnesium content, comprising the following steps:

S1. Extracted organic phase preparation: a synergistic extractant was prepared from 2-hexyldecanoic acid and HBL110 extractant, sulfonated kerosene was added into the synergistic extractant to dilute and then saponified with sodium hydroxide, the dilution rate of the synergistic extractant was controlled to be 50%, the saponification rate was controlled to be 70%, and the order of saponification was controlled to be 1, so as to obtain an extracted organic phase; wherein the volume ratio of 2-hexyldecanoic acid to HBL110 extractant is 1:8;

S2. Nickel-cobalt co-extraction: an extracted organic phase was mixed with a laterite nickel ore leaching solution with a high calcium and magnesium content to perform nickel-cobalt co-extraction, the volume ratio of the extracted organic phase to the laterite nickel ore leaching solution with a high calcium and magnesium content was controlled to be 1:3, and the order of extraction of the nickel-cobalt co-extraction was controlled to be 5 to obtain a first loaded organic phase and a raffinate; in the laterite nickel ore leaching solution with a high calcium and magnesium content, the content of calcium ions was 0.7 g/L, the content of magnesium ions was 6 g/L;

S3. Calcium magnesium washing: the first loaded organic phase was washed with a washing solution, the concentration of the washing solution was controlled to be 0.15 mol/L, the volume ratio of the first loaded organic phase to the washing solution was controlled to be 1:0.25, and the order of washing was controlled to be 4, to obtain a second loaded organic phase and washing water, and the washing water was refluxed to the laterite nickel ore leaching solution with a high calcium and magnesium content;

S4. Anti-co-extraction: a reverse extracting solution was added into the second loaded organic phase to perform back extraction, the concentration of the reverse extracting solution was controlled to be 2.5 mol/L, and the volume ratio of the second loaded organic phase to the reverse extracting solution was controlled to be 1:0.1, and the order of reverse extraction was controlled to be 6 to obtain a nickel-cobalt salt solution and an organic phase after reverse extraction, wherein the nickel-cobalt salt solution is crystallized to obtain a nickel-cobalt salt;

S5. Extracted organic phase regeneration: the reverse extracted organic phase was subjected to a saponification treatment, the order of saponification was 1, to obtain a regenerated extracted organic phase.

Example 2

A treatment method for laterite nickel ore leaching solution with high calcium and magnesium content, comprising the following steps:

S1. Extracted organic phase preparation: a synergistic extractant was prepared from 2-hexyldecanoic acid and HBL110 extractant, sulfonated kerosene was added into the synergistic extractant to dilute and then saponified with liquid alkali, the dilution rate of the synergistic extractant was controlled to be 40%, the saponification rate was controlled to be 60%, and the order of saponification was controlled to be 1, so as to obtain an extracted organic phase; wherein the volume ratio of 2-hexyldecanoic acid to HBL110 extractant is 1:8;

S2. Nickel-cobalt co-extraction: an extracted organic phase was mixed with a laterite nickel ore leaching solution with a high calcium and magnesium content to perform nickel-cobalt co-extraction, the volume ratio of the extracted organic phase to the laterite nickel ore leaching solution with a high calcium and magnesium content was controlled to be 1:2, and the order of extraction of the nickel-cobalt co-extraction was controlled to be 5 to obtain a first loaded organic phase and a raffinate; in the laterite nickel ore leaching solution with a high calcium and magnesium content, the content of calcium ions was 0.7 g/L, the content of magnesium ions was 6 g/L;

S3. Calcium magnesium washing: the first loaded organic phase was washed with a washing solution, the concentration of the washing solution was controlled to be 0.15 mol/L, the volume ratio of the first loaded organic phase to the washing solution was controlled to be 1:0.2, and the order of washing was controlled to be 4, to obtain a second loaded organic phase and washing water, and the washing water was refluxed to the laterite nickel ore leaching solution with a high calcium and magnesium content;

S4. Anti-co-extraction: a reverse extracting solution was added into the second loaded organic phase to perform back extraction, the concentration of the reverse extracting solution was controlled to be 2.5 mol/L, and the volume ratio of the second loaded organic phase to the reverse extracting solution was controlled to be 1:0.1, and the order of reverse extraction was controlled to be 6 to obtain a nickel-cobalt salt solution and an organic phase after reverse extraction, wherein the nickel-cobalt salt solution is crystallized to obtain a nickel-cobalt salt;

S5. Extracted organic phase regeneration: the reverse extracted organic phase was subjected to a saponification treatment, the order of saponification was 1, to obtain a regenerated extracted organic phase.

Example 3

A treatment method for laterite nickel ore leaching solution with high calcium and magnesium content, comprising the following steps:

S1. Extracted organic phase preparation: a synergistic extractant was prepared from 2-hexyldecanoic acid and HBL110 extractant, sulfonated kerosene was added into the synergistic extractant to dilute and then saponified with liquid alkali, the dilution rate of the synergistic extractant was controlled to be 25%, the saponification rate was controlled to be 60%, and the order of saponification was controlled to be 1, so as to obtain an extracted organic phase; wherein the volume ratio of 2-hexyldecanoic acid to HBL110 extractant is 1:8;

S2. Nickel-cobalt co-extraction: an extracted organic phase was mixed with a laterite nickel ore leaching solution with a high calcium and magnesium content to perform nickel-cobalt co-extraction, the volume ratio of the extracted organic phase to the laterite nickel ore leaching solution with a high calcium and magnesium content was controlled to be 1:1.25, and the order of extraction of the nickel-cobalt co-extraction was controlled to be 4 to obtain a first loaded organic phase and a raffinate; in the laterite nickel ore leaching solution with a high calcium and magnesium content, the content of calcium ions was 0.7 g/L, the content of magnesium ions was 6 g/L;

S3. Calcium magnesium washing: the first loaded organic phase was washed with a washing solution, the concentration of the washing solution was controlled to be 0.1 mol/L, the volume ratio of the first loaded organic phase to the washing solution was controlled to be 1:0.2, and the order of washing was controlled to be 4, to obtain a second loaded organic phase and washing water, and the washing water was refluxed to the laterite nickel ore leaching solution with a high calcium and magnesium content;

S4. Anti-co-extraction: a reverse extracting solution was added into the second loaded organic phase to perform back extraction, the concentration of the reverse extracting solution was controlled to be 2.5 mol/L, and the volume ratio of the second loaded organic phase to the reverse extracting solution was controlled to be 1:0.1, and the order of reverse extraction was controlled to be 5 to obtain a nickel-cobalt salt solution and an organic phase after reverse extraction, wherein the nickel-cobalt salt solution is crystallized to obtain a nickel-cobalt salt;

S5. Extracted organic phase regeneration: the reverse extracted organic phase was subjected to a saponification treatment, the order of saponification was 1, to obtain a regenerated extracted organic phase.

Comparative Example 1

A treatment method for laterite nickel ore leaching solution with high calcium and magnesium content, otherwise as in Example 1, except that the HBL110 extractant of the synergistic extractant was removed.

Comparative Example 2

A treatment method for laterite nickel ore leaching solution with high calcium and magnesium content, otherwise as in Example 1, except that the 2-hexyldecanoic acid of the synergistic extractant was removed.

Comparative Example 3

A treatment method for laterite nickel ore leaching solution with high calcium and magnesium content, otherwise as in Example 1, except that the volume ratio of 2-hexyldecanoic acid to HBL110 extractant in the synergistic extractant was 1:1.

Comparative Example 4

A treatment method for laterite nickel ore leaching solution with high calcium and magnesium content, otherwise as in Example 1, except that the synergistic extractant comprises 2-hexyldecanoic acid and HBL110 in a volume ratio of 1:20.

Comparative Example 5

A treatment method for laterite nickel ore leaching solution with high calcium and magnesium content, otherwise the same as in Example 1, except that step S3 did not comprise refluxing the washing water.

Evaluation Test

The raffinate and nickel-cobalt salt solution obtained in Examples 1 to 3 and Comparative Examples 1 to 5 were collected, and the main components and contents thereof in the raw material, laterite nickel ore leaching solution with a high calcium and magnesium content (hereinafter referred to as raw material) were tested, and the test results are shown in Table 1.

TABLE 1

Test results of components in each group

| Item | Group | Ni | Co | Ca | Mg |
|---|---|---|---|---|---|
| Example 1 | Raw material (g/L) | 3.6 | 0.35 | 0.7 | 6 |
| | Raffinate (g/L) | <0.001 | | 0.54 | 5.4 |
| | Nickel-cobalt salt solution (g/L) | 114.8 | 12.85 | <0.001 | |
| Example 2 | Raw material (g/L) | 3.6 | 0.35 | 0.7 | 6 |
| | Raffinate (g/L) | 0.0005 | 0.090 | 0.49 | 5.2 |
| | Nickel-cobalt salt solution (g/L) | 96.4 | 11.2 | <0.0008 | |
| Example 3 | Raw material (g/L) | 3.6 | 0.35 | 0.7 | 6 |
| | Raffinate (g/L) | <0.001 | | 0.57 | 5.5 |
| | Nickel-cobalt salt solution (g/L) | 58.7 | 6.4 | <0.001 | |
| Comparative Example 1 | Raw material (g/L) | 3.6 | 0.35 | 0.7 | 6 |
| | Raffinate (g/L) | <0.001 | | 0.32 | 5.6 |
| | Nickel-cobalt salt solution (g/L) | 56.3 | 4.6 | 0.025 | 0.003 |
| Comparative Example 2 | Raw material (g/L) | 3.6 | 0.35 | 0.7 | 6 |
| | Raffinate (g/L) | 0.0007 | 0.27 | 0.5 | 5.4 |
| | Nickel-cobalt salt solution (g/L) | 89.2 | 1.8 | <0.0005 | |
| Comparative Example 3 | Raw material (g/L) | 3.6 | 0.35 | 0.7 | 6 |
| | Raffinate (g/L) | <0.001 | | 0.5 | 5.1 |
| | Nickel-cobalt salt solution (g/L) | 71.8 | 5.3 | 0.007 | 0.0016 |
| Comparative Example 4 | Raw material (g/L) | 3.6 | 0.35 | 0.7 | 6 |
| | Raffinate (g/L) | 0.0005 | 0.041 | 0.48 | 5.4 |
| | Nickel-cobalt salt solution (g/L) | 93.0 | 9.7 | <0.001 | |
| Comparative Example 5 | Raw material (g/L) | 3.6 | 0.35 | 0.7 | 6 |
| | Raffinate (g/L) | <0.001 | | 0.57 | 4.8 |
| | Nickel-cobalt salt solution (g/L) | 92.5 | 8.9 | <0.001 | |

The synergistic extractant for the nickel-cobalt salt solution is shown in Table 1. The nickel-cobalt salt solution in Examples 1-3 of this scheme has a high purity of nickel-cobalt and low content of calcium-magnesium impurities, while the raffinate does not contain nickel-cobalt, indicating that the synergistic extractant of this scheme has a good effect of co-extracting nickel-cobalt in the liquid system with a high content of calcium-magnesium leaching solution, and the recovery rate of nickel-cobalt is close to 100%. Comparative Examples 1 and 2 are single extraction, in Comparative Example 1, calcium and magnesium will hydrolyze to form a precipitate that is continuously enriched in the organic phase, the phase separation effect of the clarification chamber of the extraction tank is affected, and the extraction efficiency of nickel and cobalt obviously decreases, the content of impurities in the product also increases, and at the same time, the pipeline is occasionally blocked, and the precipitate needs to be cleaned regularly; the extraction rate of cobalt in Comparative Example 2 was very low. In Comparative Example 1 and Comparative Example 2, the liquid volume of the laterite nickel ore leaching solution with a high calcium and magnesium content is the same as that in Example 1, and the volumes of the raffinate and the nickel-cobalt salt solution obtained are also the same. It can be seen from Table 1 that the nickel-cobalt extraction rates in Comparative Example 1 and Comparative Example 2 are significantly lower than that in Example 1, and the nickel-cobalt salt solution in Comparative Example 1 has more calcium and magnesium impurities, and the effect of a single extraction is far less than that in Example 1 of the present scheme; in comparison to Example 1, Comparative Example 3, due to the excessive proportion of 2-hexyldecanoic acid, calcium, and magnesium are still hydrolyzed to form precipitates enriched in the organic phase; Comparative Example 4 The cobalt in the laterite nickel ore was not fully recovered; in Comparative Example 5, the recovery rate of nickel and cobalt was significantly reduced. Synergistic extractants indicate that in the synergistic extraction reagent of the present scheme, 2-hexyldecanoic acid cannot be replaced by any acid, and the first extraction reagent cannot be replaced by any other nickel-cobalt extraction reagent for refluxing. The 2-hexyldecanoic acid in the synergistic extractant in this scheme is replaced with Versatic10 which has the closest extraction selectivity and 2-hexyldecanoic acid, and it is found that the extraction rate of nickel and cobalt in the extraction section will decrease continuously because the proportion of Versatic10 in the extracted organic phase becomes smaller and smaller due to the high water solubility of Versatic10. The HBL110 extractant and the HBL116 extractant in this patent are used as components of a synergistic extraction system, after extracting nickel and cobalt, the pH of the leaching solution decreases, which can solve the problem of calcium and magnesium hydrolysis during extraction and ensure the normal operation of the extraction tank.

Although the preferred embodiments of the disclosure have been disclosed for illustrative purposes, those skilled in the art will appreciate that various modifications, additions, and substitutions are possible, without departing from the scope and spirit of the invention as disclosed in the accompanying claims.

What is claimed is:

1. A treatment method for laterite nickel ore leaching solution with high calcium and magnesium content, comprising the following steps:

S1. preparing a synergistic extractant from 2-hexyldecanoic acid and a first extractant, diluting the synergistic extractant by adding a diluent, and then saponifying with a liquid alkali to obtain an extracted organic phase, wherein the first extractant is an HBL110 extractant or an HBL116 extractant;

S2. mixing the extracted organic phase with a laterite nickel ore leaching solution with a high calcium and magnesium content, and performing nickel-cobalt co-extraction to obtain a first loaded organic phase and a raffinate; wherein in the laterite nickel ore leaching solution with a high calcium and magnesium content, the content of calcium ions is 0.5-1 g/L, the content of magnesium ions is 4-7 g/L, the content of nickel ions is 2.5-4 g/L and the content of cobalt ions is 0.2-0.5 g/L;

S3. washing the first loaded organic phase with a washing solution to obtain a second loaded organic phase and washing water, wherein the washing water is refluxed to the laterite nickel ore leaching solution with a high calcium and magnesium content;

S4. adding a reverse extracting solution to the second loaded organic phase for reverse extracting to obtain a nickel-cobalt salt solution product and a reverse extracted organic phase, and crystallizing the nickel-cobalt salt solution to obtain a nickel-cobalt salt; and S5. saponifying the reverse extracted organic phase to obtain a regenerated extracted organic phase.

2. The treatment method for laterite nickel ore leaching solution with high calcium and magnesium content according to claim 1, wherein the volume ratio of the 2-hexyldecanoic acid to the first extractant is: 1:3-15.

3. The treatment method for laterite nickel ore leaching solution with high calcium and magnesium content according to claim 1, wherein in step S1, the diluent comprises one or more of sulfonated kerosene, 260 #solvent oil or Escaid 110 solvent oil, and the saponifying agent for saponification comprises one or more of sodium hydroxide, nickel hydroxide, and ammonia.

4. The treatment method for laterite nickel ore leaching solution with high calcium and magnesium content according to claim 1, wherein in step S1, the dilution rate of the synergistic extractant is 10-50%, the saponification rate is 20-70%, and the order of saponification is 1-2.

5. The treatment method for laterite nickel ore leaching solution with high calcium and magnesium content according to claim 1, wherein in step S2, the volume ratio of the extracted organic phase to the laterite nickel ore leaching solution with a high calcium and magnesium content is 1:0.5-7.

6. The treatment method for laterite nickel ore leaching solution with high calcium and magnesium content according to claim 1, wherein in step S3, the concentration of the washing solution is 0.05-0.5 mol/L, and the volume ratio of the first loaded organic phase to the washing solution is 1:0.1-0.5; the washing solution comprises one or more of a sulfuric acid solution, a hydrochloric acid solution, a nitric acid solution, a phosphoric acid solution, an acetic acid solution and a citric acid solution.

7. The treatment method for laterite nickel ore leaching solution with high calcium and magnesium content according to claim 1, wherein in step S4, the concentration of the reverse extracting solution is 0.5-2.5 mol/L, and the volume ratio of the second loaded organic phase to the reverse extracting solution is 1:0.05-1; the reverse extracting solution comprises one or more of a sulfuric acid solution, a hydrochloric acid solution, a nitric acid solution, a phosphoric acid solution, an acetic acid solution, and a citric acid solution.

8. The treatment method for laterite nickel ore leaching solution with high calcium and magnesium content according to claim 1, wherein in step S5, the order of saponification is 1-2.

9. A nickel-cobalt salt crystal obtained by the treatment method according to claim 1.

10. Use of the nickel-cobalt salt crystal according to claim 9 in a battery.

* * * * *